US012331467B2

(12) United States Patent
Salam

(10) Patent No.: US 12,331,467 B2
(45) Date of Patent: Jun. 17, 2025

(54) GLYOXYLATED STARCH ADDITIVE FOR PULP PRODUCTS

(71) Applicant: THE BOARD OF TRUSTEES OF WESTERN MICHIGAN UNIVERSITY, Kalamazoo, MI (US)

(72) Inventor: Abdus Salam, Kalamazoo, MI (US)

(73) Assignee: Board of Trustees of Western Michigan University, Kalamazoo, MI (US)

( * ) Notice: Subject to any disclaimer, the term of this patent is extended or adjusted under 35 U.S.C. 154(b) by 235 days.

(21) Appl. No.: 18/125,507

(22) Filed: Mar. 23, 2023

(65) Prior Publication Data

US 2023/0304226 A1 Sep. 28, 2023

Related U.S. Application Data

(60) Provisional application No. 63/323,246, filed on Mar. 24, 2022.

(51) Int. Cl.

| | |
|---|---|
| ***D21H 21/20*** | (2006.01) |
| ***D21H 17/07*** | (2006.01) |
| ***D21H 17/29*** | (2006.01) |
| ***D21H 17/64*** | (2006.01) |
| ***D21H 23/10*** | (2006.01) |

(52) U.S. Cl.

CPC ..... *D21H 21/20* (2013.01); *D21H 17/07* (2013.01); *D21H 17/29* (2013.01); *D21H 17/64* (2013.01); *D21H 23/10* (2013.01)

(58) Field of Classification Search

None

See application file for complete search history.

(56) References Cited

U.S. PATENT DOCUMENTS

| | | | | | |
|---|---|---|---|---|---|
| 3,219,518 | A * | 11/1965 | Barber | D21H 17/29 | 106/206.1 |
| 4,663,448 | A * | 5/1987 | Chiu | D21H 17/28 | 106/206.1 |
| 4,675,394 | A * | 6/1987 | Solarek | C08B 31/12 | 162/158 |
| 4,731,162 | A * | 3/1988 | Solarek | C08B 37/0087 | 536/84 |
| 4,741,804 | A * | 5/1988 | Solarek | C08B 11/14 | 162/178 |
| 2021/0054548 | A1 | 2/2021 | Salam et al. | | |

* cited by examiner

*Primary Examiner* — John J Figueroa
(74) *Attorney, Agent, or Firm* — David J. Johnson

(57) ABSTRACT

A glyoxylate starch may be formed by dispersing a starch in a liquid to form a starch slurry. The starch may be one or more of a cationic starch, nonionic starch, and an anionic starch. 2-chloracetamide is added to the starch slurry mixture to form a first reaction mixture. The temperature of the first reaction mixture may then be raised, and then cooled to form a modified starch, and glyoxal may be added to the modified starch solution to form a second reaction mixture that may then be stirred to produce a glyoxylate starch.

16 Claims, 7 Drawing Sheets

GLYOXYLATED STARCH ADDITIVE FOR PULP PRODUCTS

CROSS REFERENCE TO RELATED APPLICATION

This application claims the benefit under 35 U.S.C. § 119(e) to U.S. Provisional Patent Application No. 63/323,246, filed Mar. 24, 2022, entitled "GLYOXYLATED STARCH ADDITIVE FOR PULP PRODUCTS," which is incorporated herein by reference in its entirety.

TECHNOLOGICAL FIELD

The disclosure relates to a novel paper strength agent and, more particularly, to a synthesized glyoxylate starch composition that may be used to increase one or more of the wet and dry strength of pulp and paper-related products.

BACKGROUND

In the manufacture of pulp related products such as tissues and towels, napkins, paper and paperboard, the wet strength properties of the product can be increased by adding so-called "paper wet strength additives". Paper strength additives may also permit a reduction in the overall basis weight of the paper product required to achieve a given paper strength, and may therefore provide a cost savings with regards to fiber raw materials. Petroleum-based glyoxylate polyacrylamide (GPAM) and other conventional paper strength additives may include urea/formaldehyde resins, melamine/formaldehyde resins, N-methylolacrylamide (NMA), polyamide epichlorohydrin (PAE), polyamine epichlorohydrin (PAE), and polyamidoamine epichlorohydrin (PAAE). These additives may be used in a variety of paper, and tissue and towel products to provide paper with improved dry and/or wet strength. For example, glyoxylate polyacrylamide (GPAM) may increase the wet strength of household tissues and towel products when these products are in contact with water in use.

SUMMARY

Aspects of the present disclosure include novel additives and processes for improving the durability of pulp products, such as, for example, tissues and towels, paper, and paperboard. The pulp products may be made of (or mainly made of) one or more renewable, bio-based materials that are biodegradable.

Another aspect of the present disclosure is a glyoxylate starch-based strength agent for paper or other materials. The strength agent may comprise a synthesized glyoxylate starch composition. The present disclosure further includes methods of preparing a glyoxylate starch-based strength agent and a process of using the synthesized glyoxylate starch to increase the wet and/or dry strength of pulp and paper-related products, such as tissues, towels, napkins, paper, and paperboard. A method of preparing synthesized glyoxylate starch may include reacting starches (cationic starch or nonionic starch or anionic starch) with chloroacetamide utilizing an etherification reaction. The starch may then be further reacted with glyoxal utilizing a chemical reaction under selected conditions to thereby form an aqueous glyoxylate starch. The strength agent (e.g. synthesized glyoxylate starch) may be applied to one or more of a paper making or converting process. This may comprise one or more of internal application of the additive (synthesized glyoxylate starch) in fiber slurry, paper surface sizing, spraying or coating, or other suitable processes.

Another aspect of the present disclosure is a method of synthesizing (forming) glyoxylate starch. The method may include dispersing at least one starch selected from the group consisting of cationic starch, nonionic starch, and anionic starch with a liquid (e.g. water or solvent) to form a dispersed starch slurry. An NaOH solution may then be combined with the dispersed starch slurry to maintain a base pH which may be about 7 to about 10, and is more preferably about 7, about 8 or about 10 to form a starch slurry mixture. The method may further include stirring the starch slurry mixture and adding 2-chloroacetamide to the starch slurry mixture to allow the 2-chloracetamide to react with the starch of the starch slurry mixture to form a first reaction mixture. It will be understood that stirring the starch slurry mixture is optional. The method may further include stirring the first reaction mixture at least about 20° C., at least about 40° or at least about 50° C. In general, the first reaction mixture may at least partially solidify if the temperature is too low. Thus, the first reaction mixture may be stirred at a temperature that is sufficient to prevent solidification of the first reaction mixture for about 1.5-5 hours, about 1-2 hours, or about 5 hours. Although the present disclosure is not limited to specific minimum and maximum stirring times, stirring may be done for one half hour (or less), as long as six hours (or more), or any suitable time. It will be understood that stirring the starch solution is optional (not required). However, stirring may be preferred because it may reduce the reaction time. The temperature of the first reaction mixture may then be raised to at least about 70° C., to at least about 80° C., or to at least about 90° C. or to at least about 95° C. The first reaction mixture may optionally be heated to a range of temperatures including about 80° C. to about 115° C., or about 95° C. to about 100° C. After stirring, the temperature of the first reaction mixture may be raised for a suitable period of time (e.g. about 10 minutes), and the first reaction mixture may then be cooled (e.g. to about room temperature) to form a modified starch selected from the group consisting of cationic starch, nonionic starch, and anionic starch. The modified starch may be dissolved in water (e.g. hot water) to form a modified starch solution. Glyoxal may be added to the modified starch solution to form a second reaction mixture. The second reaction mixture may be stirred at about 20° C. to about 70° C., or about 20° C. to about 40° C., or about 40° C. to about 70° C., or about 70° C. for a period of time (e.g. about 30 minutes to about 120 minutes, or about 90 minutes) to produce glyoxylate starch selected from the group of glyoxylate cationic starch, glyoxylate nonionic starch, and glyoxylate anionic starch.

A specific example of forming glyoxylate starch is as follows. First, 5.0 g cornstarch was dispersed with 150 ml isopropyl alcohol in a conical flask. About 10 mL NaOH (15% concentrate) solution was combined with the dispersed cornstarch in a conical flask. The mixture was then stirred with a magnetic bar for about 10 minutes, and 5.0 g of 2-chloroacetamide was then slowly added into the mixture to allow the reaction with cornstarch. The reaction mixture was stirred with magnet stirrer at about 40° C. for about 5 hours, and the temperature was then raised to about 90° C. for about 10 minutes, followed by ambient cooling to room temperature. The product was then filtered, washed with deionized water until a neutralized pH was achieved and then air-dried overnight.

Another aspect of the present disclosure is an aqueous glyoxylated starch including starch, a modifying agent, and glyoxal. A weight ratio of water to starch of the aqueous glyoxylated starch may be from about 99.9:0.1 to about 1,000:500, or about 99.1:1 to about 1,000:500. A weight ratio of the modifying agent to the starch of the aqueous glyoxylated starch may be from about 1:1 to about 1:1,000. The starch may be selected from the group consisting of cationic starch, anionic starch, and non-anionic starch. The modifying agent may comprise a chloroacetamide. About 0.1 wt % to about 50 wt % of the aqueous glyoxylated starch may be starch. The modifying agent may comprise about 0.1 wt % to about 500 wt % of the aqueous glyoxylated starch. The aqueous glyoxylated starch may be synthesized utilizing a chemical reaction between starch and glyoxal. The chemical reaction between starch and glyoxal may occur at a reaction temperature of from about 1° C. to about 300° C., or about room temperature to about 300° C. For example, the reaction may start at room temperature and increase to about 300° C. to thereby reduce the reaction time. A reaction time of the chemical reaction between the starch and glyoxal to form the glyoxylated starch compound may be from about 0.01 minutes to about 10,000 minutes, or about 1.0 minutes to about 10,000 minutes. The aqueous glyoxylated starch may be biodegradable.

The synthesized glyoxylate starch may optionally be used as a wet and/or dry strength additive for pulp fiber products, including paper, wipes, tissues, towels, napkins, paperboard, paper-based food containers, paper-based cups, double recreped (DRC) items, and textiles.

These and other features, advantages, and objects of the present device will be further understood and appreciated by those skilled in the art upon studying the following specification, claims, and appended drawings.

DETAILED DESCRIPTION OF EMBODIMENTS

For purposes of description herein the terms "upper," "lower," "right," "left," "rear," "front," "vertical," "horizontal," and derivatives thereof are not limiting, and it is to be understood that the disclosure may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
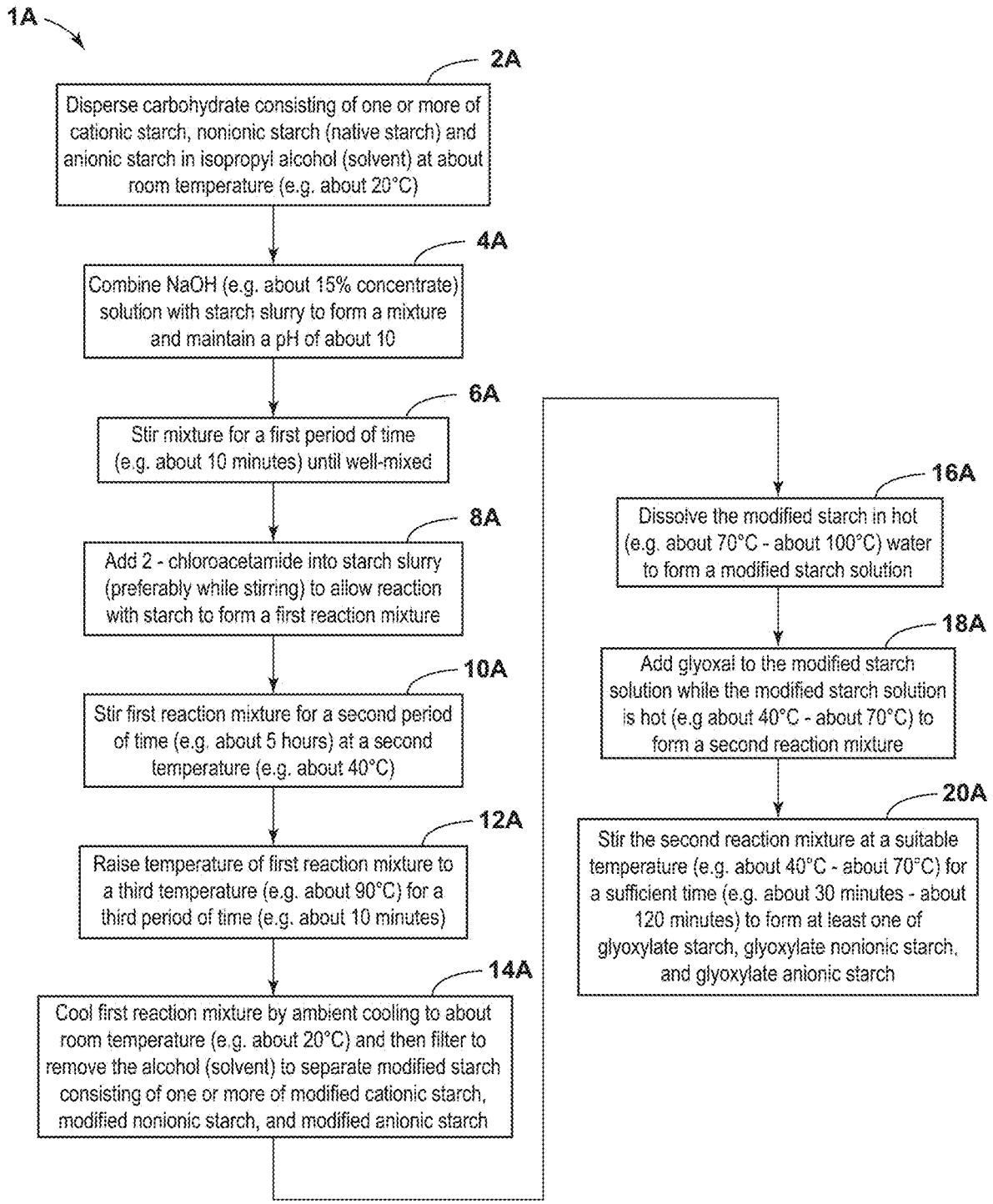
FIG. 1 is a flow chart showing a method of synthesizing a glyoxylate starch composition according to one aspect of the present disclosure.
Figure 1A:
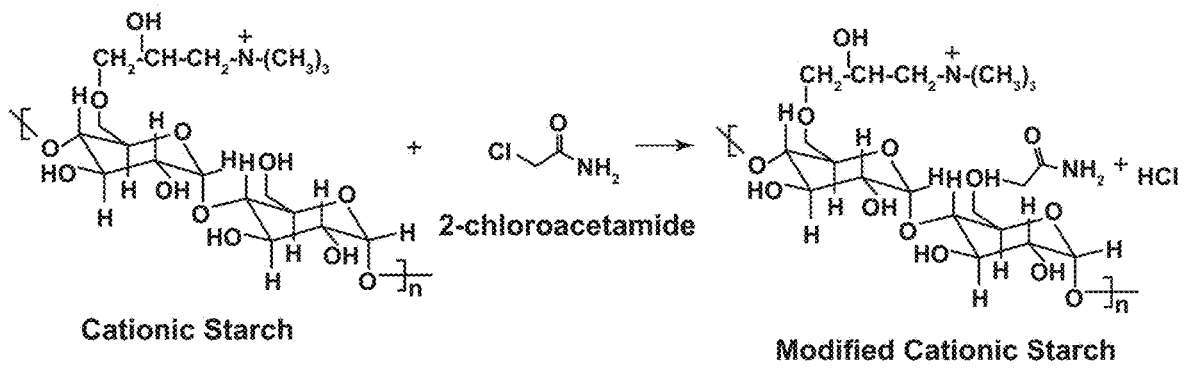
FIG. 1A is a flow diagram showing starch being reacted with chloroacetamide.
Figure 1B:
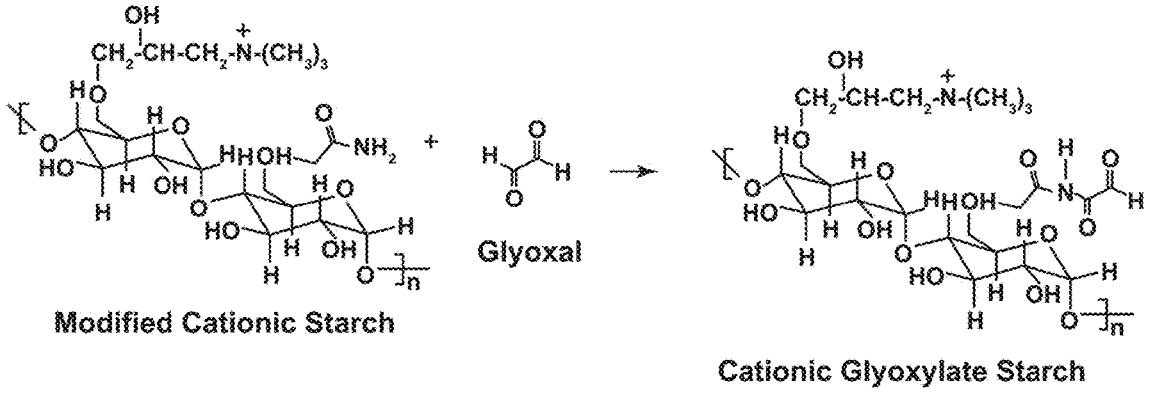
FIG. 1B is a flow diagram showing modified starch being reacted with glyoxal to produce glyoxate starch.

Processes or methods according to the present disclosure are shown in FIGS. 1, 1A, 1B, and 2. As discussed in more detail below, a method/process according to an aspect of the present disclosure may involve two steps. First, starch may be reacted with chloroacetamide as shown in FIG. 1A. Second, the modified starch may then be reacted with glyoxal to produce glyoxate starch as shown in FIG. 1B.

FIG. 1 depicts steps in an aspect 1A of the present disclosure where the starch is initially dissolved in isopropyl alcohol. Step 2A generally includes dispersing a carbohydrate that may consist of one or more of a cationic starch, a nonionic starch, and an anionic starch in water to form a starch slurry, which may be at a first temperature. The first temperature may be about room temperature (e.g. about 40° C.). At step 4A, a (NaOH) solution (e.g. 15% concentrate, or other suitable concentrate) is combined with the starch slurry formed during step 2A while maintaining a pH of about 10.8 to form a mixture. It will be understood that in the processes described herein, the pH does not necessarily need to be exactly 10.8 in order to achieve the desired reaction. For example, a pH in the range of about 9.5 to about 10.5, or a pH in the range of about 9.0 to about 11.0, or a pH outside these ranges may be utilized. Also, it will be understood that virtually any suitable agent (e.g. magnesium hydroxide) or combination of agents may be utilized to provide a suitable pH, and NaOH is merely an example of one suitable compound. At step 6A, the mixture formed at step 4A may be stirred for a first period of time (e.g. about 10 minutes or other suitable time) until the mixture is well mixed.

At step 8A, 2-chloroacetamide is added into the starch slurry formed at step 6A (preferably while stirring) to allow reaction of the 2-chloroacetamide with the starch to form a first reaction mixture. At step 10A, the first reaction mixture that was formed at step 8A is then stirred for a second period of time (e.g. about 5 hours or other suitable period of time) at a second temperature. The second temperature may be room temperature or other suitable temperature (e.g. about 40° C.) as required to facilitate the reaction. At step 12A, the temperature of the first reaction mixture may be raised to a third temperature (e.g., about 90° C. or other suitable temperature) for a third period of time. The third period of time may be about 10 minutes or other suitable period of time. At step 14A, the first reaction mixture may then be cooled by ambient cooling or other suitable cooling methodology to approximately room temperature (e.g. about 20° C.), and then may be filtered to remove the solvent, to thereby form a modified starch that may consist of one or more of modified cationic starch, a modified nonionic starch, and a modified anionic starch.

At step 16A, a modified starch is dissolved in hot water (e.g. about 70° C. to about 90° C. or 100° C. or other suitable temperature) to form a modified starch solution. At step 18A, glyoxal is added to the modified starch solution while the modified starch solution is hot (e.g. about 40° C. or 70° C. to about 90° C. or other suitable temperature) to form a second reaction mixture. As shown at step 20A, the second reaction mixture may then be stirred at a suitable temperature (e.g., about 40° C. to 60° C. to about 90° C. or other suitable temperature) for a sufficient time (e.g., about 30 minutes to about 120 minutes or other suitable time period) to form at least one of glyoxylate starch, glyoxylate nonionic starch, and glyoxylate anionic starch.

Figure 2:
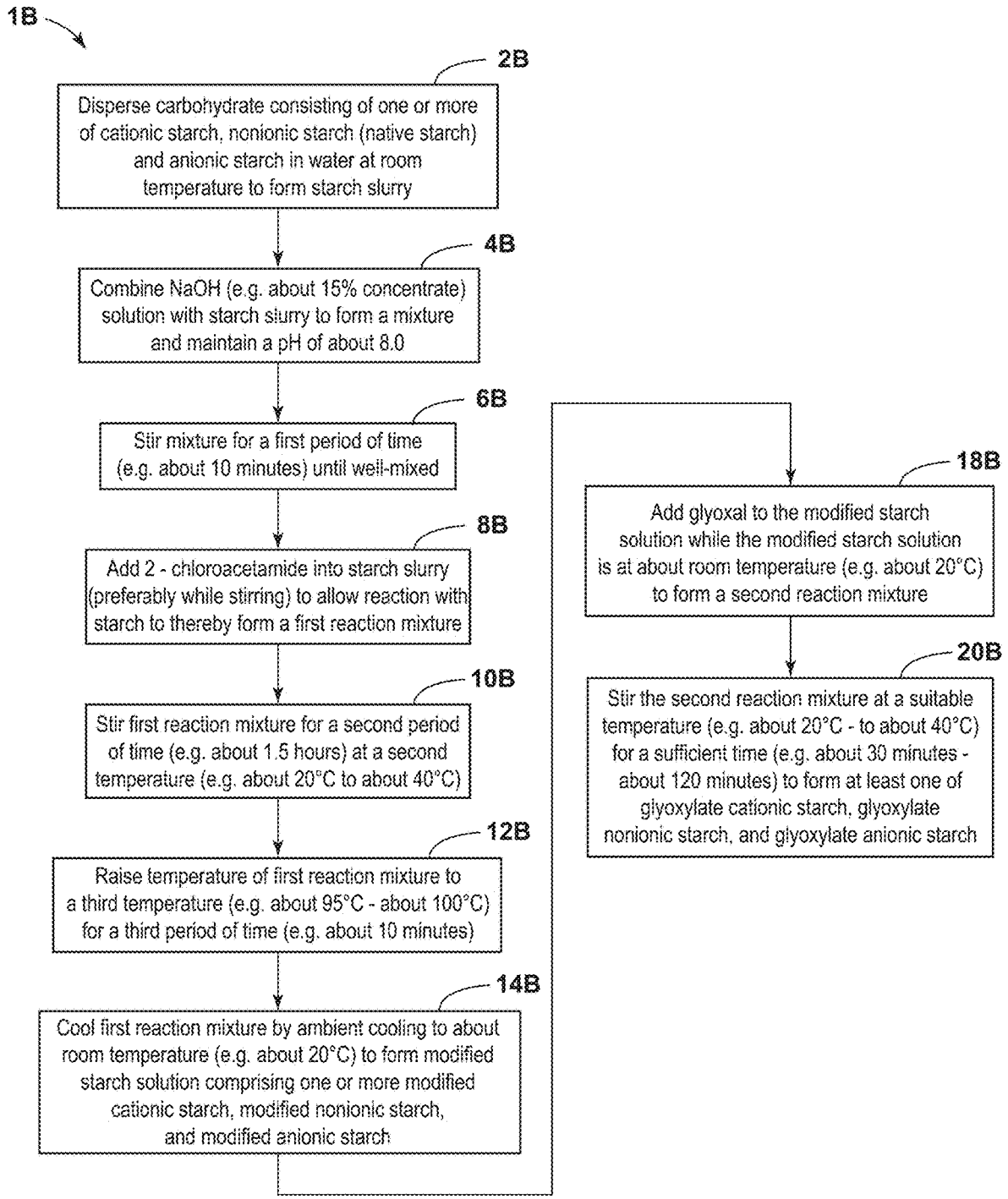
FIG. 2 is a flow chart showing a method of synthesizing a glyoxylate starch composition according to another aspect of the present disclosure.

With reference to FIG. 2, in a process 1B, glyoxylate is prepared with water only. Specifically, at step 2B, carbohydrate consisting of one or more of cationic starch, nonionic starch (native starch) and anionic starch is dispersed in water at a first temperature to form a starch slurry. At step 4B, NaOH (e.g. about 15% concentrate) solution is combined with the starch slurry formed at step 2B to form a mixture and to maintain a pH of about 8. It will be understood that in the processes described herein, the pH does not necessarily need to be exactly 8 in order to achieve the desired reaction. For example, a pH in the range of about 7.5 to about 8.5, or a pH in the range of about 7.0 to about 9.0, or a pH outside these ranges may be utilized. At step 6B, the mixture is stirred for a first period of time (e.g. about 10 minutes) until the mixture is well-mixed. At step 8B, 2-chloroacetamide is added into the starch slurry (preferably while stirring) to allow reaction with starch to thereby form a first reaction mixture. At step 10B, the first reaction mixture is then stirred for a second period of time (e.g. about 1.5 hours) at a second temperature (e.g. room temperature, or about 20° C., to about 40° C. to 50° C.). The temperature of the first reaction mixture is then raised to a third temperature (e.g. about 80° C. to 115° C., about 95° C. to about 100° C. for third period of time) (e.g. about 10 minutes). At step 14B, the first reaction mixture is cooled by ambient cooling to room temperature (e.g. about 20° C.) to thereby form a modified starch solution including one or more of modified cationic starch, modified nonionic starch, and modified anionic starch. At step 18B, glyoxal is added to the modified starch solution while the modified starch solution is at room temperature (e.g. about 20° C.). At step 20B, the second reaction mixture is stirred at a suitable temperature (e.g. about 20° C. to about 40° C.) for a sufficient time (e.g. about 30 minutes to about 120 minutes) to form at least one of glyoxylate cationic starch, glyoxylate nonionic starch, and glyoxylate anionic starch.

Glyoxylate starch-based paper strength agents (glyoxylate starch solutions) may be prepared and used as follows. In an experiment, starch (cationic, anionic and nonionic-native starch) was modified with chloroacetamide through a chemical reaction in: a) an aqueous media, b) a solvent media (alcohol) separately (solvent media based modified starch may be separated by filtration to remove the solvent and then dissolved with hot water), and c) glyoxylate with glyoxal. Glyoxal was added to the modified starch solution to form glyoxylate starch through a chemical reaction. The glyoxal/modified starch mixture solution was stirred for a required period of time at a selected temperature to promote reaction between amine groups of modified starch and aldehyde groups of glyoxal to thereby produce a glyoxylate functional group that contains starch. Example 1: 1 liter of modified starch solution was prepared by using 50 g modified starch and 950 g hot water. Example 2: 1 liter of glyoxylate starch solution was prepared by using 50 g modified starch, 240 g glyoxal, and 830 g water.

According to another aspect of the present disclosure, hand sheet paper may also be formed. In an experiment, about 0.5% glyoxylate starch solution (based on OD pulp) was mixed with pulp slurry (0.3% consistency) and stirred for about 1 minute before making a hand sheet paper sample. The hand sheet paper was prepared with a hand sheet molding machine. The hand sheet paper samples were dried at 105° C. in an air oven.

Analysis of hand sheet paper samples properties: The dried hand sheet paper samples were characterized in terms of strength properties such as dry and wet tensile strength, measured in Newtons. These were determined according to TAPPI Standard Methods "Tensile properties of paper and paperboard (using constant rate of elongation apparatus)" ref: T 494 om-06.

Figure 3:
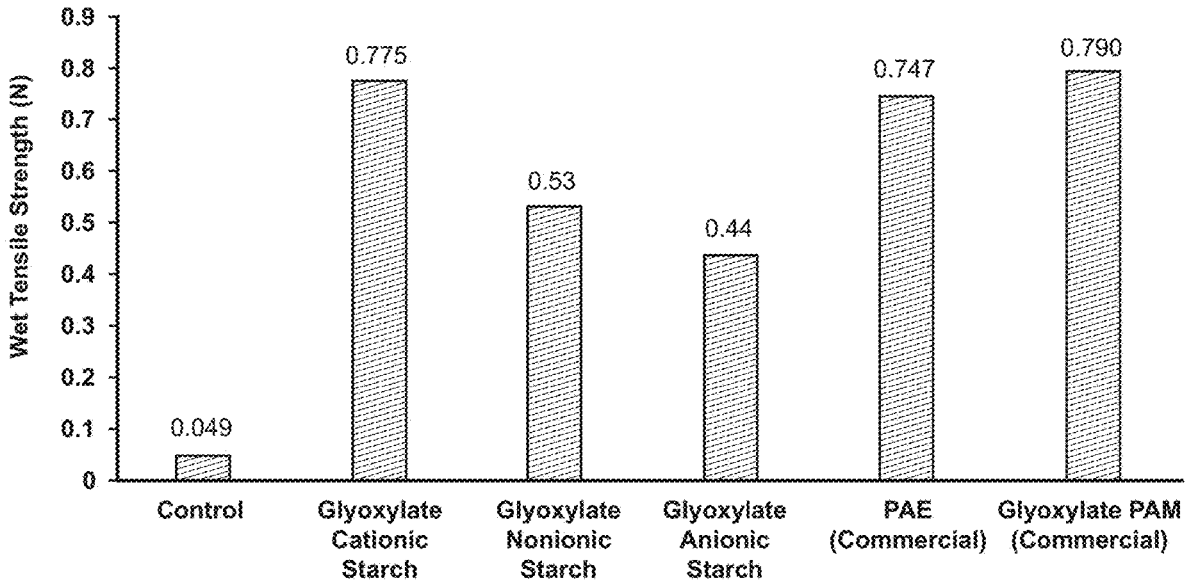
FIG. 3 is a graph depicting wet strength of pulp paper sheet (62 gsm) with synthesized glyoxylate starch embodiment and commercial paper wet and dry strength additive (PAE) as well as a glyoxylate PAM additive.

With further reference to FIG. 3, test results show that starches according to an aspect of the present disclosure may confer significantly increased wet tensile strength of pulp paper sheet (62 gsm) compared to unmodified starch (i.e. starch that has not been modified as described herein). The unmodified starch is designated "Control" in FIG. 3. The wet tensile strength of commercially available PAE and glyoxylate PAM treatments are also shown in FIG. 3.

Figure 4:
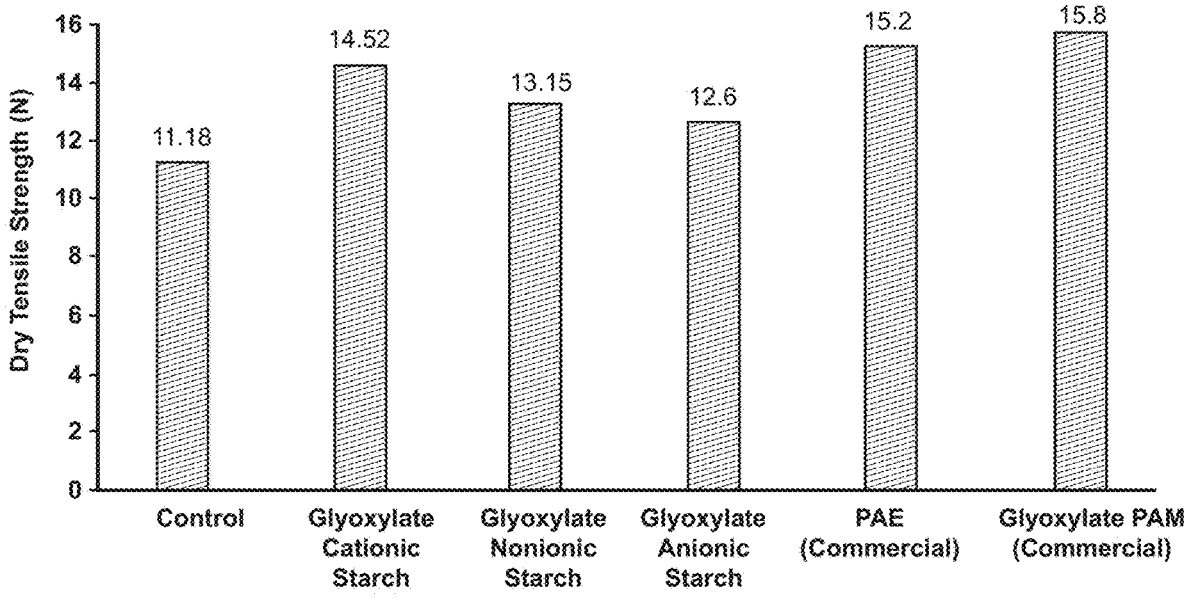
FIG. 4 is a graph depicting dry strength of pulp paper sheet (62 gsm) with synthesized glyoxylate starch embodiment and commercial paper wet and dry strength additive (PAE) as well as a glyoxylate PAM additive.

With further reference to FIG. 4, test results also show that pulp paper sheet (62 gsm) treated with synthesized glyoxylate starch according to an aspect of the present disclosure has increased dry tensile strength relative to a control paper that has not been treated with glyoxylated starch. The dry tensile strength of commercially available PAE and glycoxylated PAE treatments are also shown in FIG. 4.

Figure 5:
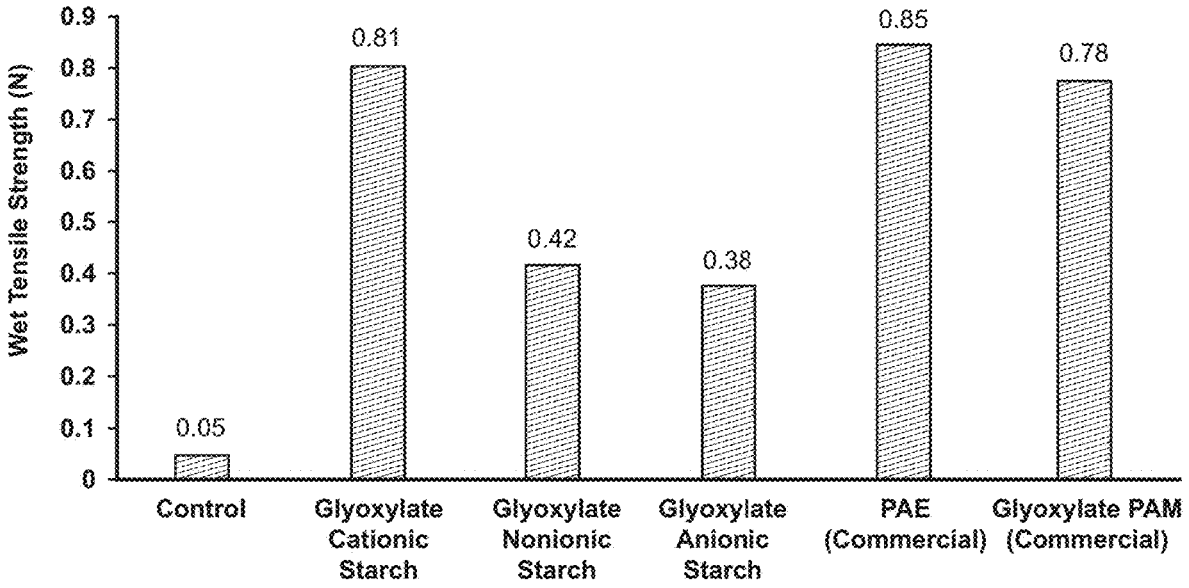
FIG. 5 is a graph depicting wet strength of tissue towel (30 gsm) with synthesized glyoxylate starch embodiment and commercial paper wet and dry strength additive (PAE) as well as a glyoxylate PAM additive.
Figure 6:
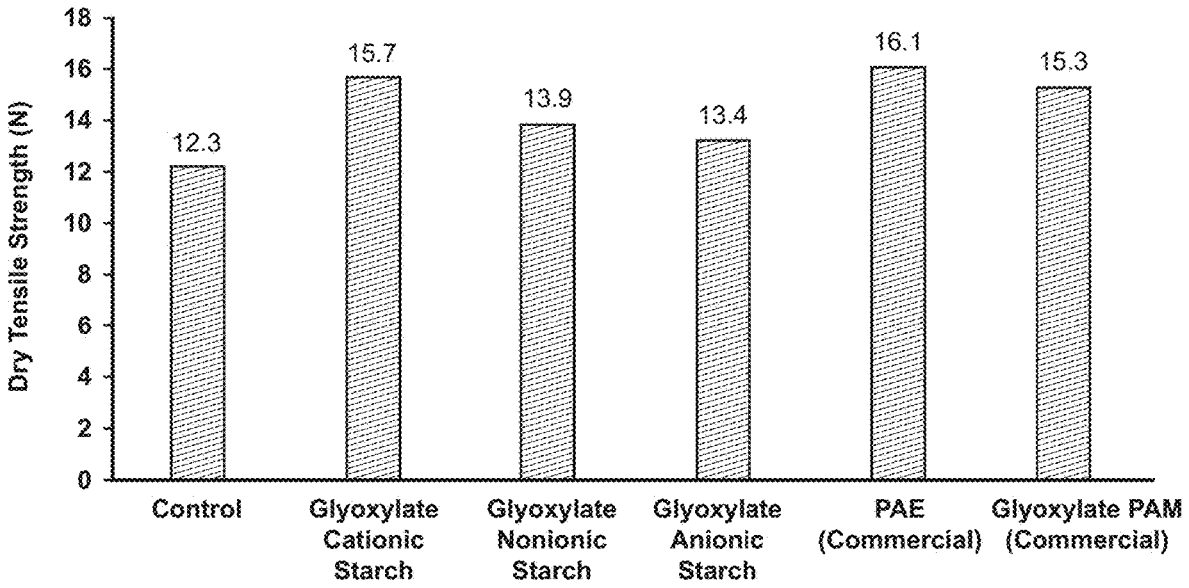
FIG. 6 is a graph depicting dry strength of tissue towel (30 gsm) with synthesized glyoxylate starch embodiment and commercial paper wet and dry strength additive (PAE) as well as a glyoxylate PAM additive.

With further reference to FIG. 5, test results for tissue sheet (30 gsm) treated with synthesized glyoxylate starch according to an aspect of the present disclosure is significantly greater than the wet tensile strength of untreated control tissue sheet. Finally, with further reference to FIG. 6, test results for tissue sheet (30 gsm) treated with synthesized glyoxylate starch according to an aspect of the present disclosure is significantly greater than the dry tensile strength of untreated control tissue sheets. The wet and dry tensile strength of commercially available PAE and glyoxylate PAM treatments are also shown in FIGS. 5 and 6.

A glyoxylate starch according to the present disclosure may be utilized to provide a bio-based carbohydrate strength agent for paper and/or other products, and may significantly increase wet and/or dry strength of pulp products while also being biodegradable. The test results described above show that a glyoxylate starch according to an aspect of the present disclosure provides increased tensile strength (wet and/or dry) in treated pulp paper sheet products, providing tensile strength that is comparable to paper treated with commercially available strength additives.

It will be understood that any described processes or steps within described processes may be combined with other disclosed processes or steps to form structures within the scope of the present device. The sequence of the process or method steps described herein are not limited to the sequences described herein unless a different sequence is not possible. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A method of synthesizing glyoxylate starch, the method comprising:

dispersing at least one starch selected from the group consisting of cationic starch, nonionic starch, and anionic starch in a liquid to form a starch slurry;

combining NaOH with the starch slurry to form a starch slurry mixture;

adding 2-chloroacetamide to the starch slurry mixture to allow the 2-chloroacetamide to react with the starch of the starch slurry mixture to form a first reaction mixture;

raising the temperature of the first reaction mixture;

followed by cooling of the first reaction mixture to about room temperature to form a modified starch solution including a modified starch selected from the group consisting of cationic starch, nonionic starch, and anionic starch;

adding glyoxal to the modified starch solution to form a second reaction mixture;

stirring the second reaction mixture to form glyoxylate starch selected from the group consisting of glyoxylate cationic starch, glyoxylate nonionic starch, and glyoxylate anionic starch.

2. The method of claim 1, wherein:

the starch slurry mixture has a pH of about 7 to about 11 prior to adding 2-chloroacetamide to the starch slurry mixture;

the starch is dispersed in water; and including:

stirring the starch slurry mixture;

dissolving the modified starch in water to form a modified starch solution.

3. The method of claim 2, wherein:

the NaOH is a solution when it is combined with the starch slurry.

4. The method of claim 3, wherein:

the mixture formed by combining NaOH with the starch slurry has a pH of about 8; or a pH of about 10.

5. The method of claim 1, including:

stirring the first reaction mixture while the first reaction mixture is at 20° C. to 50° C.

6. The method of claim 5, including:

stirring the first reaction mixture for at least 5 hours while the first reaction mixture is at 40° C.

7. The method of claim 1, including:

the first reaction mixture is stirred for 1.5 hours to 5.0 hours.

8. The method of claim 1, wherein:

stirring the first reaction mixture for 1-2 hours while the first reaction mixture is at 15° C. to 25° C.

9. The method of claim 1, wherein:

the temperature of the first reaction mixture is raised to at least 90° C.

10. The method of claim 1, wherein:

the temperature of the first reaction mixture is raised to at least 80° C. while the first reaction mixture is stirred or after the first reaction mixture is stirred;

the first reaction mixture is then cooled to room temperature.

11. The method of claim 1, including:

stirring the second reaction mixture at a temperature of 20° C. to 70° C. for at least 30 minutes.

12. The method of claim 1, wherein:

the starch is dispersed in a solvent.

13. The method of claim 12, wherein:

the modified starch solution is formed by dissolving the modified starch in water having a temperature of at least about 70° C.

14. The method of claim 12, including:

filtering the first reaction mixture to separate the modified starch.

15. The method of claim 1, wherein:

glyoxal is added to the modified starch solution while the modified starch solution is at room temperature.

16. The method of claim 1, including:

mixing the glyoxylate starch with a pulp slurry;

followed by drying the pulp slurry.

* * * * *